US011319191B2

(12) United States Patent
Yamanaka et al.

(10) Patent No.: US 11,319,191 B2
(45) Date of Patent: May 3, 2022

(54) PASSENGER CONVEYOR DISPLAY DEVICE, AND PASSENGER CONVEYOR

(71) Applicant: Hitachi, Ltd., Tokyo (JP)

(72) Inventors: Naoki Yamanaka, Tokyo (JP); Shohei Kanayama, Tokyo (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 17/287,856

(22) PCT Filed: Oct. 29, 2018

(86) PCT No.: PCT/JP2018/040021
§ 371 (c)(1),
(2) Date: Apr. 22, 2021

(87) PCT Pub. No.: WO2020/089957
PCT Pub. Date: May 7, 2020

(65) Prior Publication Data

US 2021/0380374 A1 Dec. 9, 2021

(51) Int. Cl.
*B66B 27/00* (2006.01)
*B66B 29/00* (2006.01)
(Continued)

(52) U.S. Cl.
CPC ..... *B66B 27/00* (2013.01); *B66B 25/00* (2013.01); *B66B 29/00* (2013.01); *B66B 21/04* (2013.01); *B66B 23/24* (2013.01)

(58) Field of Classification Search
CPC ..... B66B 25/00; B66B 25/003; B66B 29/08; B66B 27/00; B66B 29/00; B66B 23/24; B66B 21/04
(Continued)

(56) References Cited

U.S. PATENT DOCUMENTS 1,985,563 A * 12/1934 Fitz Gerald ..... G01V 8/12 198/322
4,798,274 A * 1/1989 Saito ..... B66B 23/225 198/324
(Continued)

FOREIGN PATENT DOCUMENTS

JP 2005-298072 A 10/2005
JP 2007-520402 A 7/2007
(Continued)

OTHER PUBLICATIONS

International Search Report (PCT/ISA/210) issued in PCT Application No. PCT/JP2018/040021 dated Jan. 15, 2019 with English translation (five (5) pages).
(Continued)

*Primary Examiner* — James R Bidwell
(74) *Attorney, Agent, or Firm* — Crowell & Moring LLP

(57) ABSTRACT

There is disclosed a display device making it possible to call effective attention in a use situation where unbalanced passenger load occurs between left and right lanes of a passenger conveyor. This display device includes a first display unit (7A) positioned on the left and a second display unit (7B) positioned on the right toward the passenger conveyor at a boarding (1), a control device (20) to control the first display unit (7A) and the second display unit (7B), and passenger detection (8A, 8B) to detect passengers stepping on the passenger conveyor. The first display unit (7A) and the second display unit (7B) display images representing information to passengers. The passengers pass between the first display unit (7A) and the second display unit (7B) and step on the passenger conveyor. The control device (20) estimates a state of congestion and a state of passengers gathering on only one lane in the passenger conveyor, based on detection signals from the passenger detection means (8A, 8B), and sets an image to be displayed
(Continued)

by the first display unit (7A) and an image to be displayed by the second display device (7B) independently, depending on the state of congestion and the state of passengers gathering on only one lane.

13 Claims, 4 Drawing Sheets

(51) Int. Cl.
*B66B 25/00* (2006.01)
*B66B 23/24* (2006.01)
*B66B 21/04* (2006.01)

(58) Field of Classification Search
USPC ..... 198/322, 323
See application file for complete search history.

(56) References Cited

U.S. PATENT DOCUMENTS 5,782,330 A * 7/1998 Mehlert ..... B66B 27/00 198/322
6,334,522 B2 * 1/2002 Haruta ..... B66B 25/00 198/322
8,141,693 B2 * 3/2012 Sansevero ..... B66B 25/006 198/324
10,351,392 B1 * 7/2019 Gurvich ..... B66B 29/00
11,192,757 B2 * 12/2021 Frossard ..... B66B 27/00
2005/0217971 A1 10/2005 Kim
2014/0076686 A1 * 3/2014 De Coi ..... B66B 25/00 198/322

FOREIGN PATENT DOCUMENTS

JP 2011-93624 A 5/2011
JP 2012-6669 A 1/2012
JP 2016-216174 A 12/2016
JP 2017-171467 A 9/2017

OTHER PUBLICATIONS

Japanese-language Written Opinion (PCT/ISA/237) issued in PCT Application No. PCT/JP2018/040021 dated Jan. 15, 2019 (three (3) pages).

* cited by examiner

PASSENGER CONVEYOR DISPLAY DEVICE, AND PASSENGER CONVEYOR

TECHNICAL FIELD

The present invention relate to a display system that displays information to passengers of a passenger conveyor and a passenger conveyor that is equipped with the display system.

BACKGROUND ART

As prior art for calling attention of passengers of a passenger conveyor to safety matters, a technology described, e.g., in Patent Literature 1 is known. The technology described in Patent Literature 1 counts the number of passengers on an escalator based on the outputs of respective passenger detection devices disposed at the escalator boarding and landing on upper and lower floors and judges a congestion situation based on the number of passengers. Then, the technology calls attention of passengers by a speaker and a display depending on the congestion situation.

CITATION LIST

Patent Literature

Patent Literature 1: Japanese Patent Application Laid-Open No. 2011-93624

SUMMARY OF INVENTION

Technical Problem

In passenger conveyor apparatus having steps of size enough to allow two passengers to stand side by side on them, a situation may occur where passengers gather on only one of two lanes in the direction of movement in congestion conditions. Also, a situation may occur where passengers may walk on the steps in one of two lanes in the direction of movement. When attempting to call attention of passengers to avoid the above situations, it is difficult for the aforementioned prior art to call effective attention to a use situation where unbalanced passenger load occurs between left and right lanes in the direction of movement, e.g., passengers gather on only one lane or walk on the steps, since the main purpose of the prior art is to prevent an excessive number of passengers from stepping on the escalator.

Therefore, the present invention provides a passenger conveyor display device and a passenger conveyor equipped with same, making it possible to call effective attention in a use situation where unbalanced passenger load occurs between the left and right lanes in the direction of movement.

Solution to Problem

To solve the problem noted previously, the passenger conveyor display device according to the present invention displays information to passengers who step on a passenger conveyor and includes a first display unit positioned on the left toward the passenger conveyor at a boarding, a second display unit positioned on the right toward the passenger conveyor at the boarding, a control device to control the first display unit and the second display unit, and passenger detection means for detecting passengers stepping on the passenger conveyor. The first display unit and the second display unit display images representing information to passengers. The passengers pass between the first display unit and the second display unit and step on the passenger conveyor. The control device estimates a state of congestion and a state of passengers gathering on only one lane in the passenger conveyor, based on detection signals from the passenger detection means, and sets an image to be displayed by the first display unit and an image to be displayed by the second display device independently, depending on the state of congestion and the state of passengers gathering on only one lane.

Also, to solve the problem noted previously, the passenger conveyor according to the present invention includes multiple steps that are driven to circulate between a boarding and a landing and moving handrails that are driven in synchronization with the steps, and is equipped with a passenger conveyor display device according to the present invention as outlined above.

Advantageous Effects of Invention

According to the present invention, it is possible to call effective attention in a use situation where unbalanced passenger load occurs between left and right lanes. Thereby, a use situation is brought about where passengers stop and step on the left and right lanes of a passenger conveyor without gathering on only one lane.

Problems, features, and advantageous effects other than described above will be made apparent from the following description of an embodiment.

DESCRIPTION OF EMBODIMENTS

Figure 1:
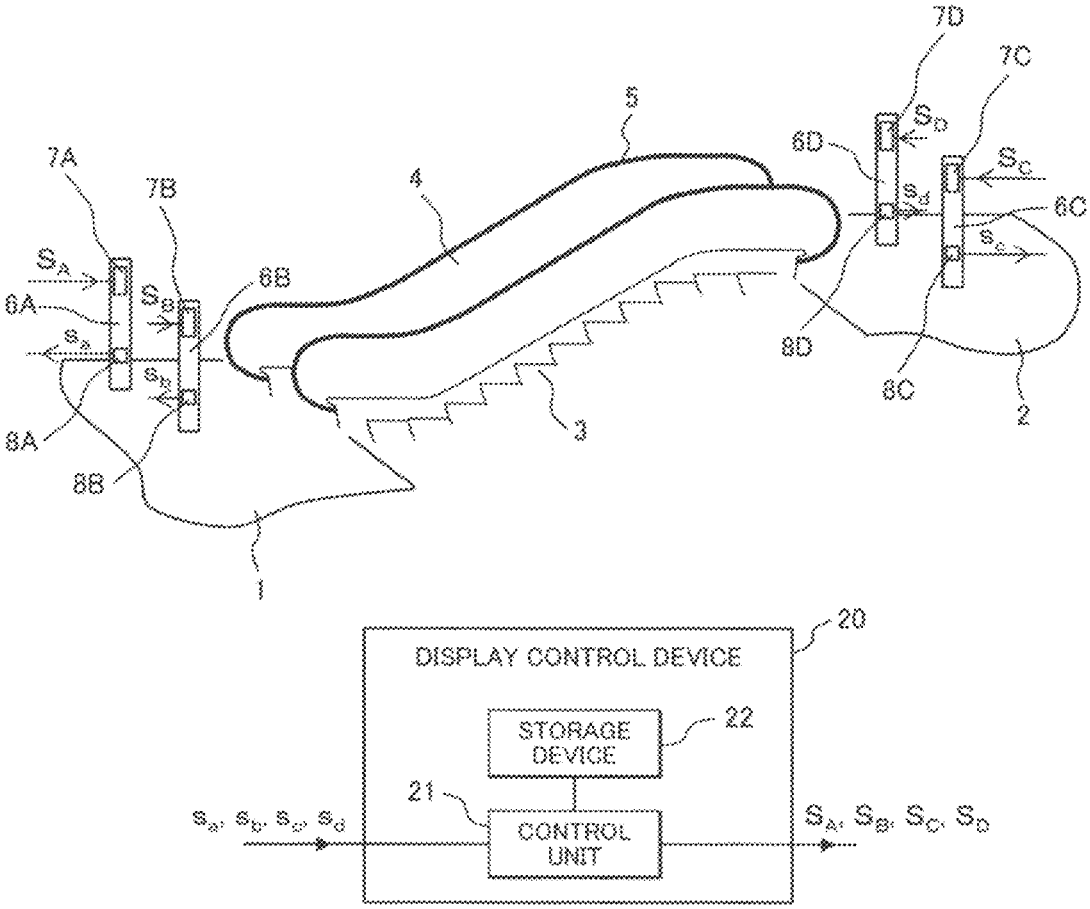
FIG. 1 depicts a schematic structure of an escalator that is one embodiment of the present invention.

In the following, an embodiment of the present invention is described with the aid of the drawings. In the respective drawings, identical reference numerals denote identical components or components having similar functions.

FIG. 1 depicts a schematic structure of an escalator that is one embodiment of the present invention. Also, FIG. 2 depicts an external view of a boarding and a landing of the escalator of the present embodiment.

Figure 2:
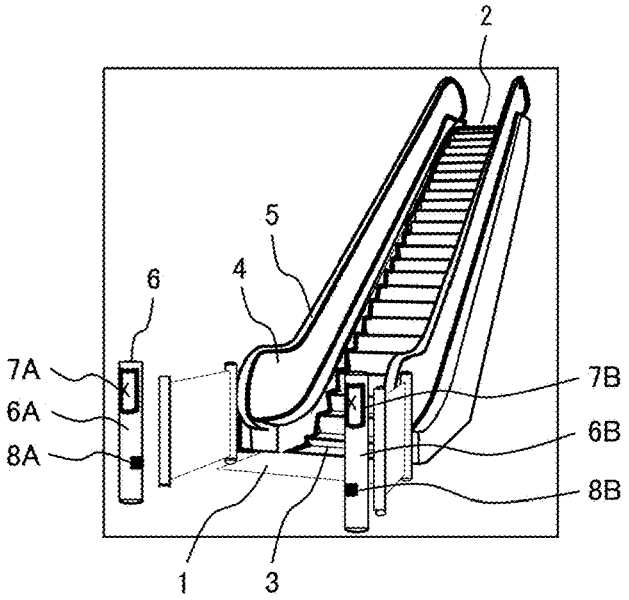
FIG. 2 depicts an external view of a boarding and a landing of the escalator of the present embodiment.

As depicted in FIGS. 1 and 2, multiple steps 3 of the escalator of the present embodiment move from a lower floor toward an upper floor in a building, i.e., from a boarding 1 toward a landing 2. In other words, the escalator of the present embodiment is set to make an ascending movement. Note that, although not depicted, the multiple steps 3 are chained endlessly and driven by a drive mechanism to make a circular movement between the boarding 1 and the landing 2. Along the direction of movement of the steps 3, a pair of balustrades 4 is provided to stand. Moving handrails 5 are slidably placed on the balustrades 4. Although not depicted, the moving handrails 5 are endless and driven by a handrail drive mechanism to make a circular movement between the boarding 1 and the landing 2 in synchronization with the steps 3. Note that, in the present embodiment, one step 3 has size enough to allow two passengers to stand side by side on it.

At the boarding 1, on a floor right before the steps 3, a pair of poles, namely, a first pole 6A and a second pole 6B are provided to stand on the left and the right, respectively, with respect to the direction of movement of the steps 3. Also, at the landing 2, a pair of poles, namely, a third pole 6C and a fourth pole 6D are provided to stand likewise. Passengers pass between the first pole 6A and the second pole 6B and step on the escalator. Also, once passengers have stepped off the escalator, after passing between the third pole 6C and the fourth pole 6D, they are to move on the upper floor.

The first pole 6A is equipped with a first display unit 7A which is formed of a liquid crystal display and a first passenger detection sensor 8A to detect passengers who pass on the left with respect to the direction of movement of the steps 3 among passengers who pass between the first pole 6A and the second pole 6B. Therefore, passengers to be detected by the first passenger detection sensor 8A step on a left lane of the escalator usually.

The second pole 6B is equipped with a second display unit 7B which is formed of a liquid crystal display and a second passenger detection sensor 8B to detect passengers who pass on the right lane with respect to the direction of movement of the steps 3 among passengers who pass between the first pole 6A and the second pole 6B. Therefore, passengers to be detected by the second passenger detection sensor 8B step on a right lane of the escalator usually.

The third pole 6C is equipped with a third display unit 7C which is formed of a liquid crystal display and a third passenger detection sensor 8C to detect passengers who stepped off the right lane mentioned above.

The fourth pole 6D is equipped with a fourth display unit 7D which is formed of a liquid crystal display and a fourth passenger detection sensor 8D to detect passengers who stepped off the left lane mentioned above.

The first to fourth display units (7A to 7D) are controlled independently one another and display images of information such as in letters, shapes, and graphics for calling attention to safety matters. The first display unit 7A and the second display unit 7B face front at the boarding 1 and display images of information relevant to calling attention of passengers who come closer to the first pole 6A and the second pole 6B to step on the escalator in order to prevent such a use situation that passengers gather on only either of the left and right lanes or passengers walk on either of the left and right lanes. For this purpose, the first display unit 7A and the second display unit 7B are controlled independently and capable of displaying images of pieces of information that differ from each other.

In addition, the third display unit 7C and the fourth display unit 7D face front at the landing 2 and display images of information for calling attention of passengers who come closer to the third pole 6C and the fourth pole 6D to step on the escalator to tell them that they cannot step on the escalator. The third display unit 7C and the fourth display unit 7D display, for example, an image of a mark and letters representing no entry. Note that, although the third display unit 7C and the fourth display unit 7D are controlled independently one another, they are controlled respectively to display an image of the same information representing no entry in the present embodiment.

The first to fourth display units (7A to 7D) are controlled independently one another by a display control device 20. The display control device 20 is equipped with a storage device 22 to store multiple pieces of image data that are to be displayed on each display unit and represent information for calling attention and a control unit 21 that generates display command signals ($S_A$, $S_B$, $S_C$, $A_D$) depending on detection signals ($s_a$, $s_b$, $s_c$, $s_c$) from the respective passenger detection sensors and sends the command signals to the respective display units (7A to 7D). The control unit 21 selects image data to be displayed on each display unit from multiple pieces of image data that the storage device 22 stores, depending on the signals ($s_a$, $s_b$, $s_c$, $s_c$) from the respective passenger detection sensors, and generates the display command signals ($S_A$, $S_B$, $S_C$, $A_D$) according to the selected image data.

As the passenger detection sensors, reflective photoelectric sensors, infrared motion sensors, etc. are applied.

Based on the detection signals ($s_a$, $s_b$, $s_c$, $s_d$) from the respective passenger detection sensors, the control unit 21 estimates a degree of congestion of passengers on the steps 3 and a degree to which passengers gather on only either of the left and right lanes with respect to the direction of movement. A concrete example of estimating means is as described below.

The control unit 21 counts the number of passengers $X_{ii}$ who stepped on the left lane of the escalator from the boarding 1 and the number of passengers $X_{10}$ who stepped off the left lane of the escalator at the landing 2, based on a detection signal $s_a$ from the first passenger detection sensor 8A and a detection signal $s_d$ from the fourth passenger detection sensor 8D, respectively. The control unit 21 also counts the number of passengers $X_{ri}$ who stepped on the right lane of the escalator from the boarding 1 and the number of passengers $X_{ro}$ who stepped off the right lane of the escalator at the landing 2, based on a detection signal $s_b$ from the second passenger detection sensor 8B and a detection signal $s_c$ from the third passenger detection sensor 8C, respectively.

The control unit 21 calculates the number of passengers $X_L$ on the left lane from a difference between $X_{li}$ and $X_{lo}$ and calculates the number of passengers $X_R$ on the right lane from a difference between $X_{ri}$ and $X_{ro}$. Then, the control unit 21 estimates a state of congestion based on the sum of $X_L$ and $X_R$, i.e., a total number of passengers riding on the escalator. The control unit 21 also estimates a state of passengers gathering on only one lane based on a comparison between $X_L$ and $X_R$.

In the present embodiment, the control unit 21 divides the total number of passengers ($=X_L+X_R$) by a predefined maximum number of people that the escalator can carry, thus calculating a passenger load factor ($=(X_L+X_R)$/(the maximum number of people that the escalator can carry)), and estimates a state of congestion depending on the calculated passenger load factor. More specifically, congestion is estimated to be small when the passenger load factor is less than 50%, medium when the passenger load factor is 50% or more and less than q70%, and large when the passenger load factor is 70% or more.

Also, in the present embodiment, the control unit 21 divides the number of passengers, which is greater, on one of the left and right lanes by the number of passengers on the other lane, thus calculating the degree to which passengers gather on only one lane, and estimates whether or not passengers are in a state of gathering on only one lane depending on the calculated degree to which passengers gather on only one lane. For instance, if the number of passengers $X_L$ on the left lane is greater than the number of passengers $X_R$ on the right lane, the control unit 21 calculates the degree to which passengers gather on only one lane based on a value of "$X_L/X_R$" and estimates whether or not passengers gather on only the left lane. More specifically, if the degree to which passengers gather on only one lane is 150% or more, the control unit 21 estimates that passengers gather on only one lane; if the degree to which passengers gather on only one lane is less than 150%, the control unit estimates that passengers do not gather on only one lane.

Note that various estimating means can be applied, not limited to the foregoing estimating means. For example, for a predetermined time, the control unit 21 counts the number of passengers $X_{li}$ who stepped on the left lane of the escalator from the boarding 1 and counts the number of passengers $X_{ri}$ who stepped on the right lane of the escalator from the boarding 1, based on the detection signal $s_a$ from the first passenger detection sensor 8A and the detection signal $s_b$ from the second passenger detection sensor 8B. Then, the control unit 21 may estimate a state of congestion and whether or not passengers gather on only one lane, based on the number of passengers $X_{li}$ and the number of passengers $X_{ri}$ counted for the predetermined time, i.e., so to speak, regarding $X_{li}$ and $X_{ri}$ as $X_L$ and $X_R$ mentioned above.

In addition, the passenger load factor mentioned above may be calculated, based on the magnitude of a load current flowing in a motor provided in the drive mechanism that drives the steps 3, not depending on a measurement value of the number of passengers. In this case, the control unit 21 stores in advance a load current value when the number of people riding on the escalator equals to the "maximum number of people that the escalator can carry", namely, a maximum load current value. The control unit 21 divides a detection value of load current that is detected by a current sensor by the maximum load current value and, thus, calculates the passenger load factor.

As will be described in the following, in the present embodiment, the control unit 21 sets image data to be displayed on each of the first display unit 7A on the left with respect to the direction of movement and the second display unit 7B on the right with respect to the direction of movement, disposed at the boarding 1, depending on a state of congestion and whether or not passengers gather on only one lane, as described above. Thereby, it is possible to display the same image or different images on the left and right display units depending on a use situation of the escalator. Therefore, it is possible to call attention of passengers to instruct them to avoid gathering on only one lane and walking, when stepping on the escalator, depending on a use situation of the escalator.

Figure 3:
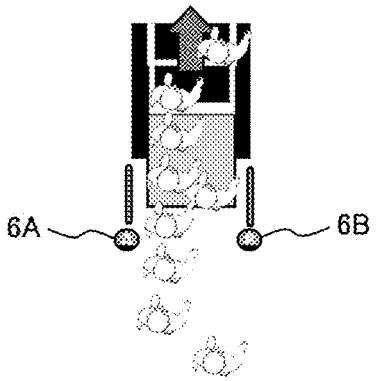
FIG. 3 is an overhead view illustrating an example of a use situation of the escalator when passengers gather on only one lane.
Figure 4:
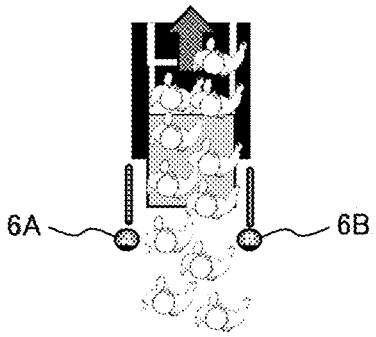
FIG. 4 is an overhead view illustrating an example of a use situation of the escalator when passengers do not gather on only one lane.

Here, a description is provided about gathering of passengers on only one lane using FIG. 3 and FIG. 4.

FIG. 3 is an overhead view illustrating an example of a use situation of the escalator when passengers gather on only one lane. FIG. 4 is also an overhead view illustrating an example of a use situation of the escalator when passengers do not gather on only one lane.

In the example of the use situation illustrated in FIG. 3, passengers who are going to step on the left lane with respect to the direction of movement of the steps (an arrow in the drawing) are standing still, whereas a passenger who is going to step on the right lane is walking. Therefore, the right lane is sparse as compared with the left lane and gathering of passengers on only the left lane occurs. When such gathering of passengers on only one lane occurs, transport efficiency decreases. A decrease in transport efficiency becomes significant especially when the degree of congestion (passenger load factor) becomes higher.

In the use situation as in FIG. 3, in the present embodiment, different pieces of image data are displayed on the fronts of the pole 6A and the pole 6B, so that it is possible to display different contents to call attention of passengers who are going to step on the left and right lanes. For example, a display on the pole 6A calls attention of passengers who are going to the left lane and alerts them that they should step on the escalator, separating into the left and right lanes, whereas a display calls attention of passengers who are going to step on the right lane and alerts them that walking is banned.

In this way, it is possible to shift the use situation of the escalator to a use situation as illustrated in FIG. 4 where passengers step on the escalator, almost evenly separating into the left and right lanes, while stopping before stepping on the escalator. In the use situation as in FIG. 4, in the present embodiment, the same image data is displayed on the front of the pole 6A (the first display unit 7A) and the front of the pole 6B (the second display unit 7B), so as to call attention of passengers who are going to step on the left and right lanes, inform them of the same thing, and continue such use situation. Additionally, even while the use situation as in FIG. 4 continues, estimating a state of congestion and whether or not passengers gather on only one lane is performed continuously. Upon occurrence of the use situation as in FIG. 3, switching is automatically performed to a display pattern in which different pieces of image data are displayed on the fronts of the left and right poles.

Then, a description is provided about images to be displayed for call attention of passengers at the boarding.

Figure 5:
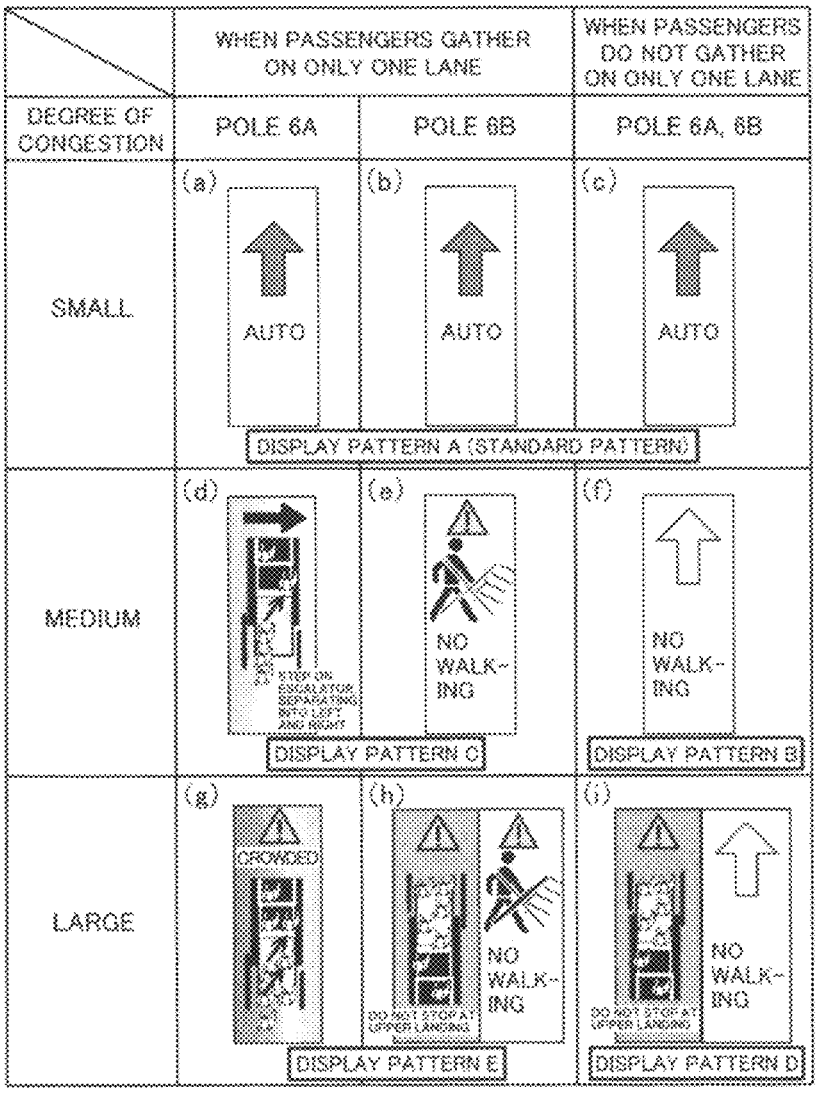
FIG. 5 presents examples of images to be displayed on display units with which poles are equipped in the present embodiment.

FIG. 5 presents examples of images to be displayed on the display units with which the poles are equipped in the present embodiment. Multiple images to be displayed, which are described below, include images ((d) to (i) in FIG. 5) for calling attention for leading to the use situation where passengers stop and step on the left and right lanes of the escalator without gathering on only one lane.

As presented in FIG. 5, images to be displayed on the first display unit 7A on the first pole 6A and images to be displayed on the second display unit 7B on the second pole 6B are set for each display unit depending on a degree of congestion and whether or not passengers gather on only one lane.

Figure 6:
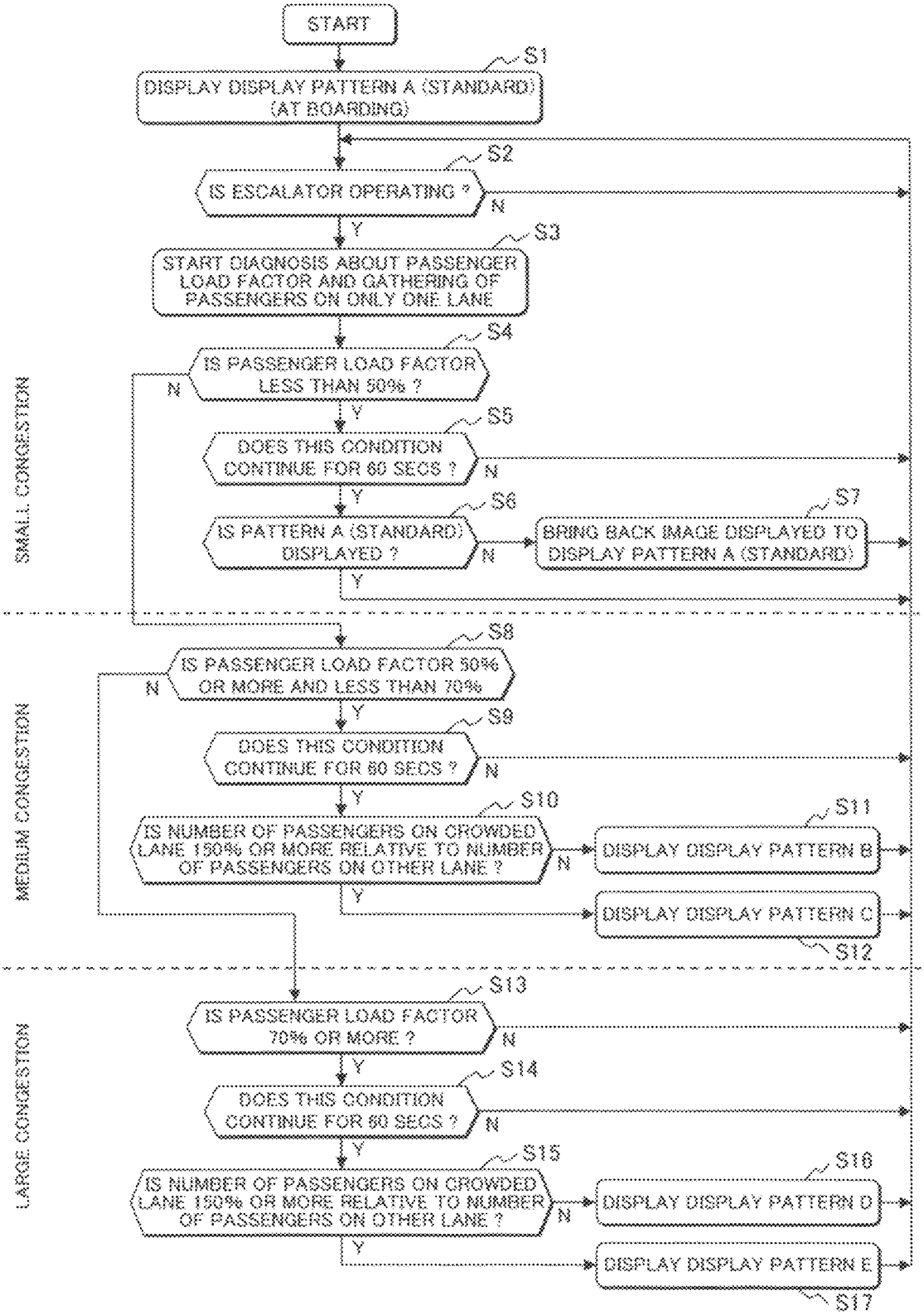
FIG. 6 is a flowchart illustrating an overview of processing that a control unit performs.

In the present embodiment, the degree of congestion of passengers on the steps 3 is classified into three levels, large, medium, and small, based on predefined thresholds ("50%" and "70%" which are mentioned in FIG. 6). In addition, a decision as to whether or not passengers gather on only one lane is made based on a predefined threshold of the degree to which passengers gather on only one lane ("150%" which is mentioned in FIG. 6). If equal to or more than the threshold, a decision is made that "passengers gather on only one lane"; if less than the threshold, a decision is made that "passengers do not gather on only one lane".

Note that, in the present embodiment, passengers may walk in the right lane with respect to the direction of movement of the steps 3. Therefore, when different images are displayed on the left and right poles, images ((e) and (h)) that alert passengers that walking is banned are displayed only on the right pole 6B of the left and right poles.

Also, in the present embodiment, information to be presented to passengers is represented in graphics or/and letters in each image to be displayed.

Also, in the present embodiment, different images are to be displayed on the left and right poles when passengers gather on only one lane. Instead, when passengers do not gather on only one lane, the same image is to be displayed on the left and right poles.

When the degree of congestion is small, images to be displayed on the left and right poles are set to a display pattern A. Note that, in the present embodiment, the display pattern A is specified as a standard pattern because time when the escalator is operating in a use condition where the degree of congestion is small is longest during escalator operation.

In the display pattern A, when passengers gather on only one lane, an image (a) and an image (b) are displayed on the left pole 6A and the right pole 6B respectively; when passengers do not gather on only one lane, an image (c) is displayed on both the left pole 6A and the right pole 6B. The images (a), (b), and (c) are identical and indicate that the escalator is in automatic operation and the direction of movement of the steps 3. In the present embodiment, the fact that the escalator is in automatic operation is represented by letters and the direction of movement of the steps 3 is represented by graphics (an arrow).

When the degree of congestion is medium, images to be displayed on the left and right poles are set to a display pattern B, if passengers do not gather on only one lane, or set to a display pattern C, if passengers gather on only one lane. In the display pattern B, i.e., when passengers do not gather on only one lane, an image (f) is displayed on both the first pole 6A and the second pole 6B.

In the display pattern B, the image (f) indicates that walking is banned. In the present embodiment, the fact that walking is banned is represented by letters.

By displaying the image (f), walking on the steps 3 is inhibited and the use situation where passengers do not gather on only one lane can be maintained.

In the display pattern C, i.e., when passengers gather on only one lane, an image (d) and an image (e) are displayed on the first pole 6A and the second pole 6B respectively. The image (d) indicates that passengers should step on the escalator, separating into the left and right lanes with respect to the direction of movement of the steps 3. In the present embodiment, the fact that passengers should step on the escalator, separating into the left and right lanes, is represented by letters and graphics (an arrow pointing a direction of the right lane and a use condition at the boarding of the escalator). The image (e) indicates that walking is banned in a more emphasized manner than the image (f). In the present embodiment, the fact that walking is banned in the image (e) is represented by letters and graphics (a passenger and a prohibition mark (X) and a warning mark).

By displaying the image (d) and the image (e), it is possible to guide passengers from the crowded left lane only on which passengers gather to the empty right lane. Also, walking on the steps 3 is inhibited and these images being displayed can lead to a favorable use situation where passengers ride on the escalator, spaced by one step 3 from a preceding passenger.

When the degree of congestion is large, images to be displayed on the left and right poles are set to a display pattern D, if passengers do not gather on only one lane, or set to a display pattern E, if passengers gather on only one lane.

In the display pattern D, an image (i) is composed of an image (left in the drawing) that alerts passengers not to stop at the landing and an image that alerts passengers that walking is banned (right in the drawing) and both images are alternately displayed repeatedly. The alert not to stop at the landing is represented by letters and graphics (a warning mark and a use condition at the landing of the escalator) and the fact that walking is banned is represented by letters.

By displaying the image (i), walking on the steps 3 is inhibited and staying of passengers at the landing can be prevented.

In the display pattern E, i.e., when passengers gather on only one lane, an image (g) and an image (h) are displayed on the first pole 6A and the second pole 6B respectively.

The image (g) indicates that the escalator is crowded and that passengers should step on the escalator, separating into the left and right lanes. In the present embodiment, the fact that the escalator is crowded is represented by letters and the fact that passengers should step on the escalator, separating into the left and right lanes is represented by graphics (a use condition at the boarding of the escalator). Moreover, a warning mark is displayed in the image (g) for calling attention in an emphasized manner.

The image (h) is composed of an image (left in the drawing) that alerts passengers not to stop at the landing and an image that alerts passengers that walking is banned (right in the drawing) and both images are alternately displayed repeatedly. In the present embodiment, the alert not to stop at the landing is represented by letters and graphics (a warning mark and a use condition at the landing of the escalator) and the fact that walking is banned is indicated in a more emphasized manner than the image (i). In the present embodiment, the fact that walking is banned in the image (h) is represented by letters and graphics (a passenger and a prohibition mark (X) and a warning mark).

By displaying the image (g) and the image (h), it is possible to guide passengers from the crowded left lane in the direction of movement to the empty right lane in the direction of movement. It is also possible to inhibit walking on the steps 3 and prevent staying passengers at the landing.

The foregoing images (a) to (i) in FIG. 5 are stored as image data in the storage device 22 (FIG. 1). The control unit 21 (FIG. 1) selects a piece of image data to be displayed on each display unit (7A, 7B) at the boarding from the image data stored in the storage device 22 depending on the degree of congestion, and the degree to which passengers gather on only one lane and sets it to be displayed on each display unit.

Note that the storage device 22 also stores image data to be displayed on each display unit (7C, 7D) at the landing, though such image data is not depicted. This image data indicates that no entry is allowed. During escalator operation, the control unit 21 (FIG. 1) selects a piece of image data indicating that no entry is allowed from the image data stored in the storage device 22 and sets it to be displayed on each display unit at the landing.

FIG. 6 is a flowchart illustrating an overview of processing that the control unit 21 in the display control device 20 performs to set image data to be displayed on the display units 7A and 7B at the boarding. Display patterns A to E mentioned in FIG. 6 are the display patterns A to E mentioned in FIG. 5 above. Note that the control unit 21 reads image data from the storage device 22, generates a display command signal ($S_A$ to $S_D$ in FIG. 1) for each display unit from the read image data, sends the display command signal to each display unit, and sets the image data to be displayed on each display unit.

When the processing is started, the control unit 21 first reads a standard pattern, namely, the display pattern A as image data from the storage device 22 and sets it to be displayed on the first display unit 7A and the second display unit 7B at the boarding (step S1).

Then, the control unit 21 decides whether the escalator is operating (step S2). Note that the control unit 21 receives a signal indicating that the escalator is operating or stopped from a drive control system, which is not depicted, and decides whether or not the escalator is operating according to this signal. Upon deciding that the escalator is not operating, i.e., it is stopped ("N" at step S2), the control unit 21 re-executes the step S2. Upon deciding that the escalator is operating ("Y" at step S2), the control unit 21 then executes step S3.

At step S3, the control unit 21 starts diagnosis about the passenger load factor (the degree of congestion) and gathering of passengers on only one lane. Specifically, according to the means described previously, the control unit 21 computes the passenger load factor (the degree of congestion) and the degree to which passengers gather on only one lane, based on the signals ($s_a$ to $s_d$ in FIG. 1) from the passenger sensors (8A to 8D in FIG. 1). After executing the step S3, the control unit 21 then executes step S4.

At step S4, the control unit 21 decides whether the passenger load factor is less than 50%. Upon deciding that the passenger load factor is not less than 50%, i.e., it equals to or more than 50% ("N" at step S42), the control unit 21 then executes step S8 which will be described later. Upon deciding that the passenger load factor is less than 50% ("Y" at step S4), i.e., congestion is small, the control unit 21 then executes step S5.

At step S5, the control unit 21 decides whether the condition in which the passenger load factor is less than 50% continues for a predetermined time (60 seconds in the present embodiment). Upon deciding that the above condition does not continue ("N" at step S5), the control unit 21 returns to the step S2 and re-executes the step S2 and subsequent steps of processing. Upon deciding that the above condition continues ("Y" at step S5), the control unit 21 then executes step S6.

At step S6, the control unit 21 decides whether image data set displayed currently on the display units (7A, 7B) is the display pattern A, i.e., the standard pattern. Upon deciding that the above image data is the display pattern A ("Y" at step S6), the control unit 21 returns to the step S2 and re-executes the step S2 and subsequent steps of processing. Upon deciding that the above image data is not the display pattern A ("N" at step S6), the control unit 21 then executes step S7.

At step S7, the control unit 21 sets the display pattern A as image data to be displayed on the display units (7A, 7B) and brings back the image displayed by the display units (7A, 7B) to the display pattern A, i.e., the standard pattern. After executing the step S7, the control unit 21 returns to the step S2 and re-executes the step S2 and subsequent steps of processing.

The foregoing steps S4 to S7 are a procedure for display when congestion is small. Upon deciding at the step S4 that the passenger load factor is not less than 50%, i.e., congestion is not small, the control unit 21 proceeds to a procedure for display when congestion is medium (steps S8 to S12).

At step S8, the control unit 21 decides whether the passenger load factor is 50% or more and less than 70%. Upon deciding that the passenger load factor is not 50% or more and less than 70% ("N" at step S8), the control unit 21 then executes step S13 which will be described later. Upon deciding that the passenger load factor is 50% or more and less than 70% ("Y" at step S8), i.e., congestion is medium, the control unit 21 then executes step S9.

At step S9, the control unit 21 decides whether the condition in which the passenger load factor is 50% or more and less than 70% continues for a predetermined time (60 seconds in the present embodiment). Upon deciding that the above condition does not continue ("N" at step S9), the control unit 21 returns to the step S2 and re-executes the step S2 and subsequent steps of processing. Upon deciding that the above condition continues ("Y" at step S9), the control unit 21 then executes step S10.

At step S10, the control unit 21 decides whether the number of passengers on a crowded lane is 150% or more relative to the number of passengers on the other lane, i.e., the degree to which passengers gather on only one lane is 150% or more. Upon deciding that the number of passengers on the crowded lane is not 150% or more ("N" at step S10), i.e., passengers do not gather on only one lane, the control unit 21 then executes step S11. Upon deciding that the number of passengers on the crowded lane is 150% or more ("Y" at step S10), i.e., passengers gather on only one lane, the control unit 21 then executes step S12.

At step S11, the control unit 21 sets the display pattern B as image data to be displayed on the display units (7A, 7B). After executing the step S11, the control unit 21 returns to the step S2 and re-executes the step S2 and subsequent steps of processing.

At step S12, the control unit 21 sets the display pattern C as image data to be displayed on the display units (7A, 7B). After executing the step S12, the control unit 21 returns to the step S2 and re-executes the step S2 and subsequent steps of processing.

The foregoing steps S8 to S12 are the procedure for display when congestion is medium. Upon deciding at the step S8 that the passenger load factor is not 50% or more and less than 70%, i.e., congestion is not medium, the control unit 21 proceeds to a procedure for display when congestion is large (steps S13 to S17).

At step S13, the control unit 21 decides whether the passenger load factor is 70% or more. Upon deciding that the passenger load factor is not 70% or more ("N" at step S13), the control unit 21 returns to the step S2 and re-executes the step S2 and subsequent steps of processing. Upon deciding that the passenger load factor is 70% or more ("Y" at step S13), i.e., congestion is large, the control unit 21 then executes step S14.

At step S14, the control unit 21 decides whether the condition in which the passenger load factor is 70% or more continues for a predetermined time (60 seconds in the present embodiment). Upon deciding that the above condition does not continue ("N" at step S14), the control unit 21 returns to the step S2 and re-executes the step S2 and subsequent steps of processing. Upon deciding that the above condition continues ("Y" at step S14), the control unit 21 then executes step S15.

At step S15, the control unit 21 decides whether the number of passengers on a crowded lane is 150% or more relative to the number of passengers on the other lane, i.e., the degree to which passengers gather on only one lane is 150% or more. Upon deciding that the number of passengers on the crowded lane is not 150% or more ("N" at step S15), i.e., passengers do not gather on only one lane, the control unit 21 then executes step S16. Upon deciding that the number of passengers on the crowded lane is 150% or more ("Y" at step S15), i.e., passengers gather on only one lane, the control unit 21 then executes step S17.

At step S16, the control unit 21 sets the display pattern D as image data to be displayed on the display units (7A, 7B). After executing the step S16, the control unit 21 returns to the step S2 and re-executes the step S2 and subsequent steps of processing.

At step S17, the control unit 21 sets the display pattern E as image data to be displayed on the display units (7A, 7B). After executing the step S17, the control unit 21 returns to the step S2 and re-executes the step S2 and subsequent steps of processing.

According to the display device embodiment described hereinbefore, the first display unit 7A disposed on the left and the second display unit 7B disposed on the right with respect to the direction of movement of the steps 3 at the boarding of the escalator are controlled independently depending on the state of congestion of passengers riding on the steps 3 and the state of passengers gathering on only one lane. Therefore, it is possible to display the same image or different images on the first display unit 7A and the second display unit 7B depending on the state of congestion and the state of passengers gathering on only one lane. Thereby, in a use situation where unbalanced passenger load occurs between the left and right lanes of the escalator, it is possible to call effective attention of passengers who are going to step on the escalator for shifting to a use situation where passengers step on the steps 3, almost evenly separating into the left and right lanes, while stopping before stepping on the escalator. Hence, gathering of passengers on only either of the left and right lanes is lessened and a use situation where passengers walk on the steps can be prevented.

In the present embodiment, the state of congestion and the state of passengers gathering on only one lane, mentioned above, are quantitatively judged by the degree of congestion (passenger load factor) and the degree to which passengers gather on only one lane, calculated based on detection signals from the passenger detection sensors to detect passengers who step on the left and right lanes. Hence, the state of congestion and the state of passengers gathering on only one lane are judged accurately. In addition, the state of congestion and the state of passengers gathering on only one lane can be classified into multiple levels. Therefore, for each of multiple combinations of the state of congestion and the state of passengers gathering on only one lane, images can be set to be displayed on each display unit (7A, 7B). Therefore, it is possible to set images finely to call attention depending on the state of congestion and the state of passengers gathering on only one lane. Displaying these images can surely lead to a use situation where passengers stop and step on the steps 3 almost evenly.

In addition, in the present embodiment, the display units (7A, 7B) and the passenger detection sensors (8A, 8B) are disposed on the poles (6A, 6B). Hence, the display device of the present embodiment can be configured using existing photoelectric poles equipped with the passenger detection sensors.

Note that the present invention is not limited to the embodiment described hereinbefore and various modifications are included therein. For example, the foregoing embodiment is that described in detail to explain the present invention clearly and the invention is not necessarily limited to that including all the components described. For a subset of the components of the embodiment, other components can be added to the subset or the subset can be removed and replaced by other components.

For example, modifications as described below are possible.

The display device of the present embodiment can be applied to a variety of passenger conveyors including a moving walk (installed slantingly or horizontally), not limited to escalators.

The display units may be equipped with an image display such as an organized EL or a plasma display, not limited to LCD.

The passenger detection sensors may be installed on the floor of the boarding or the escalator skirt guard, not limited to the poles.

In addition, cameras may be used as the passenger detection sensors. In this case, the cameras may be installed on, inter alia, the ceiling or triangular area guard plates for preventing a person from being caught in that area. An overall image of the escalator may be acquired by the cameras and passengers may be detected through image processing.

In addition, the foregoing embodiment may be modified as follow: the state of congestion may be classified into optional multiple levels not limited to three levels of small, medium, and large, depending on the degree of congestion (passenger load factor). Also, the state of passengers gathering on only one lane may be classified into optional multiple levels not limited to two levels corresponding to whether or not passengers gather on only one lane, depending on the degree to which passengers gather on only one lane.

REFERENCE SIGNS LIST

1 . . . boarding, 2 . . . landing, 3 . . . steps, 4 . . . balustrades, 5 . . . moving handrails, 6A . . . first pole, 6B . . . second pole, 6C . . . third pole, 6D . . . fourth pole, 7A . . . first display unit, 7B . . . second display unit, 7C . . . third display unit, 7D . . . fourth display unit, 8A . . . first passenger detection sensor, 8B . . . second passenger detection sensor, 8C . . . third passenger detection sensor, 8D . . . fourth passenger detection sensor, 20 . . . display control device, 21 . . . control unit, 22 . . . storage device, $s_a$, $s_b$, $s_c$, $s_d$ . . . detection signals, $S_A$, $S_B$, $S_C$, $S_D$ . . . display command signals

The invention claimed is:

1. A passenger conveyor display device that displays information to passengers who step on a passenger conveyor, the passenger conveyor display device comprising:

a first display unit positioned on the left toward the passenger conveyor at a boarding;

a second display unit positioned on the right toward the passenger conveyor at the boarding;

a control device to control the first display unit and the second display unit; and passenger detection means for detecting passengers stepping on the passenger conveyor, wherein the first display unit and the second display unit display images representing information to the passengers;

the passengers pass between the first display unit and the second display unit and step on the passenger conveyor;

the control device estimates a state of congestion and a state of passengers gathering on only one lane in the passenger conveyor, based on detection signals from the passenger detection means; and the control device sets an image to be displayed by the first display unit and an image to be displayed by the second display device independently, depending on the state of congestion and the state of passengers gathering on only one lane.

2. The passenger conveyor display device according to claim 1, wherein the control device sets the same image to be displayed by the first display unit and the second display unit, depending on the state of congestion and the state of passengers gathering on only one lane; and the control device sets different images to be displayed by the first display unit and the second display unit, depending on the state of congestion and the state of passengers gathering on only one lane.

3. The passenger conveyor display device according to claim 1, wherein the control device calculates a degree of congestion and a degree to which passengers gather on only one lane in the passenger conveyor, based on the detection signals from the passenger detection means, and estimates the state of congestion and the state of passengers gathering on only one lane depending on the degree of congestion and the degree to which passengers gather on only one lane.

4. The passenger conveyor display device according to claim 3, wherein the state of congestion is classified into multiple levels depending on the degree of congestion;

the state of passengers gathering on only one lane is classified into multiple levels depending on the degree to which passengers gather on only one lane;

the control device stores in advance multiple images corresponding to the multiple levels of the state of congestion and the multiple levels of the state of passengers gathering on only one lane; and the control device selects an image to be displayed by the first display unit and an image to be displayed by the second display unit from the multiple images depending on the state of congestion and the state of passengers gathering on only one lane.

5. The passenger conveyor display device according to claim 4, wherein the multiple images include an image for calling attention for leading to a use situation where passengers stop and step on left and right lanes of the passenger conveyor without gathering on only one lane.

6. The passenger conveyor display device according to claim 5, wherein the multiple images include any of an image that alerts passengers that they should step on the passenger conveyor, separating into the left and right lanes; an image that alerts passengers that walking is banned on the passenger conveyor; and an image that alerts passengers not to stop at an landing of the passenger conveyor.

7. The passenger conveyor display device according to claim 1, wherein the passenger detection means includes a first passenger detection sensor positioned on the left toward the passenger conveyor at the boarding and a second passenger detection sensor positioned on the right toward the passenger conveyor at the boarding.

8. The passenger conveyor display device according to claim 1, wherein the first display unit is disposed on a first pole positioned on the left toward the passenger conveyor at the boarding; and the second display unit is disposed on a second pole positioned on the right toward the passenger conveyor at the boarding.

9. The passenger conveyor display device according to claim 7, wherein the first passenger detection sensor is disposed on the first pole positioned on the left toward the passenger conveyor at the boarding; and the second passenger detection sensor is disposed on the second pole positioned on the right toward the passenger conveyor at the boarding.

10. The passenger conveyor display device according to claim 1, wherein the first display unit and the second display unit are formed of liquid crystal display devices.

11. A passenger conveyor comprising multiple steps that are driven to circulate between a boarding and a landing and moving handrails that are driven in synchronization with the steps, the passenger conveyor being equipped with a display device that displays information to passengers who step on the passenger conveyor, the display device including:

a first display unit positioned on the left toward the passenger conveyor at the boarding;

a second display unit positioned on the right toward the passenger conveyor at the boarding;

a control device to control the first display unit and the second display unit; and passenger detection means for detecting passengers stepping on the passenger conveyor, wherein the first display unit and the second display unit display images representing information to the passengers;

the passengers pass between the first display unit and the second display unit and step on the passenger conveyor;

the control device estimates a state of congestion and a state of passengers gathering on only one lane in the passenger conveyor, based on detection signals from the passenger detection means; and the control device sets an image to be displayed by the first display unit and an image to be displayed by the second display device independently, depending on the state of congestion and the state of passengers gathering on only one lane.

12. The passenger conveyor according to claim 11, wherein the control device sets the same image to be displayed by the first display unit and the second display unit, depending on the state of congestion and the state of passengers gathering on only one lane; and the control device sets different images to be displayed by the first display unit and the second display unit, depending on the state of congestion and the state of passengers gathering on only one lane.

13. The passenger conveyor according to claim 12, wherein the passenger detection means includes a first passenger detection sensor positioned on the left toward the passenger conveyor at the boarding and a second passenger detection sensor positioned on the right toward the passenger conveyor at the boarding;

the first display unit and the first passenger detection sensor are disposed on a first pole positioned on the left toward the passenger conveyor at the boarding; and the second display unit and the second passenger detection sensor are disposed on a second pole positioned on the right toward the passenger conveyor at the boarding.

* * * * *